United States Patent [19]

McCutcheon

[11] 4,396,215

[45] Aug. 2, 1983

[54] LOG GRAPPLE DEVICE

[75] Inventor: John A. McCutcheon, Thorndale, Canada

[73] Assignee: Timberjack Inc., Ontario, Canada

[21] Appl. No.: 295,344

[22] Filed: Aug. 24, 1981

[51] Int. Cl.[3] ..... B66C 3/16; F15B 13/042

[52] U.S. Cl. ..... 294/88; 91/437; 414/730

[58] Field of Search ..... 294/86 R, 88, 106; 60/560, 562, 563; 91/421, 433, 437–441, 449, 450; 414/621, 626, 730, 739

[56] References Cited

U.S. PATENT DOCUMENTS 3,152,706 10/1964 Conrad ..... 294/88 X
3,627,351 12/1971 Zimmerman et al. ..... 294/88 X
3,854,766 12/1974 Jordan ..... 294/88
4,313,633 2/1982 Muntjanoff et al. ..... 294/88

*Primary Examiner*—Johnny D. Cherry
*Attorney, Agent, or Firm*—C. H. Grace; F. M. Sajovec

[57] ABSTRACT

A hydraulic system (10) for a log grapple device (12), including an unloader valve (20) and an accumulator (22) located downstream of a control valve (18) which determines the direction of fluid flow to the actuating cylinder (108) controlling the opening and closing of the grapple device. When a predetermined operating pressure is reached the unloader valve diverts outlet flow from a pump (16) to a reservoir (14) and isolates the system downstream of the unloader valve, the accumulator maintaining pressure on the grapple device. When the grapple device is to be opened, a pilot check valve assembly (60) within the unloader valve permits reverse flow through the unloader valve.

6 Claims, 2 Drawing Figures

LOG GRAPPLE DEVICE

The present invention relates to log grapples, and more particularly to a system for maintaining a squeezing force on a load of logs in a grapple independent of the main hydraulic system.

In a log grapple, such as that shown in U.S. Pat. No. 3,620,394 a plurality of logs are gripped by the tongs of a grapple mechanism mounted on a skidder vehicle for transport from one location to another location for processing. In the course of transporting the logs, they are likely to shift within the grapple tongs, and unless means are provided to maintain pressure of the tongs against the logs, the logs are likely to slip out. In such a system it is also important that such means not require the continuous pumping of oil through the vehicle hydraulic system since this can cause overheating and undue wear of the pump and other hydraulic components.

U.S. Pat. No. 3,854,766 provides a system as described above which provides a hydraulic system including an accumulator and an unloader valve; however, the grapple control valve is located downstream of the unloader valve, and tests on such a system have shown that leakage around the control valve spool can be so high as to cause undue cycling of the unloader valve. While this condition can be avoided by the use of a closed center control valve, such valves are quite expensive.

The present invention provides a system including an accumulator and an unloader valve which is downstream of the control valve and is thus independent of leakage in the control valve. In order for such a system to operate properly it is necessary to reverse the oil flow in the work line to the grapple to open the grapple, and to accomplish this the present invention provides a pilot check valve installed in parallel in the work line, and a check valve in the drain line from the unloader valve. To reduce cost and facilitate installation, the unloader valve, the pilot check valve and the check valve are incorporated in a single unit.

Figure 1:
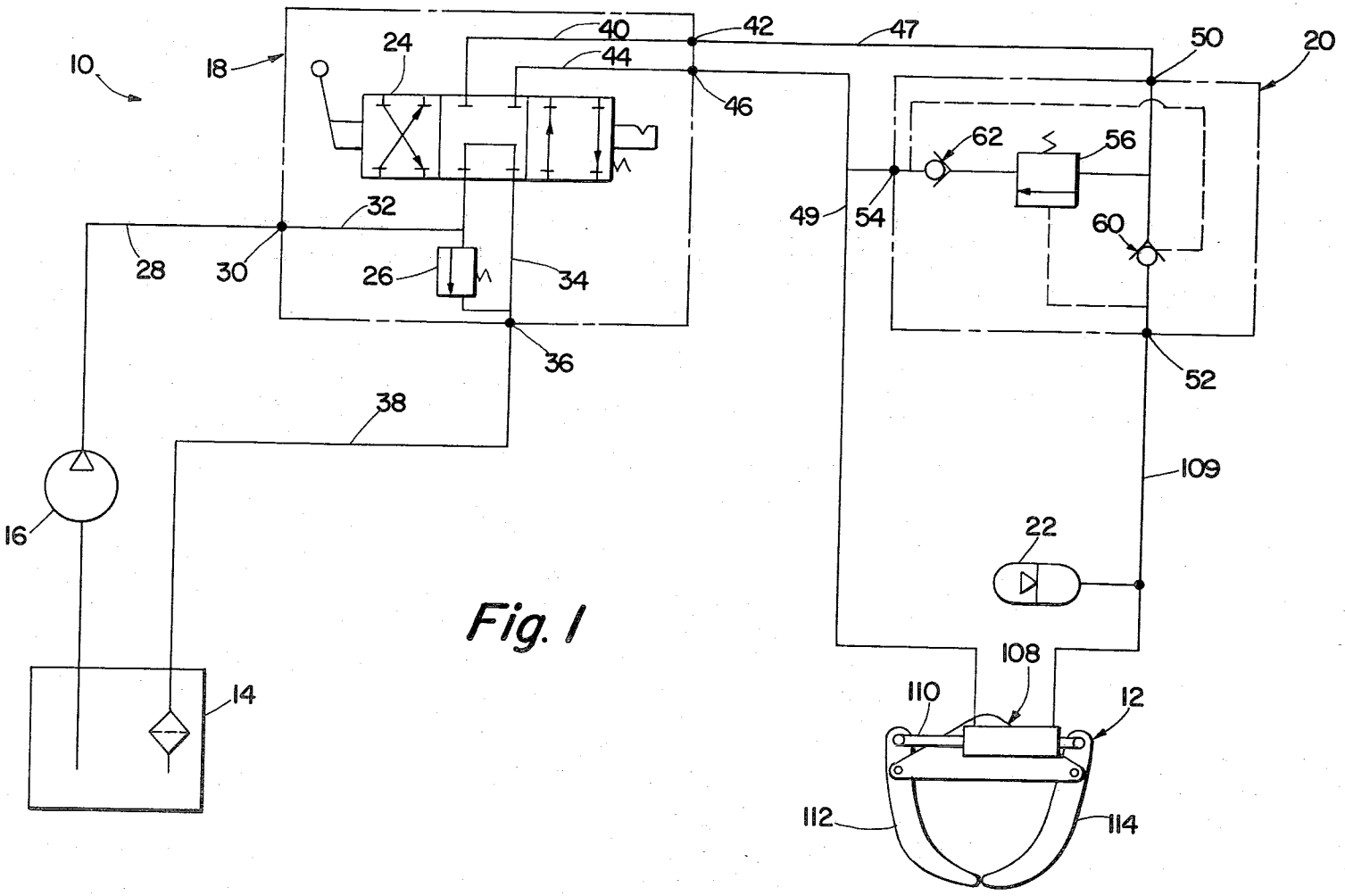
Figure 2:
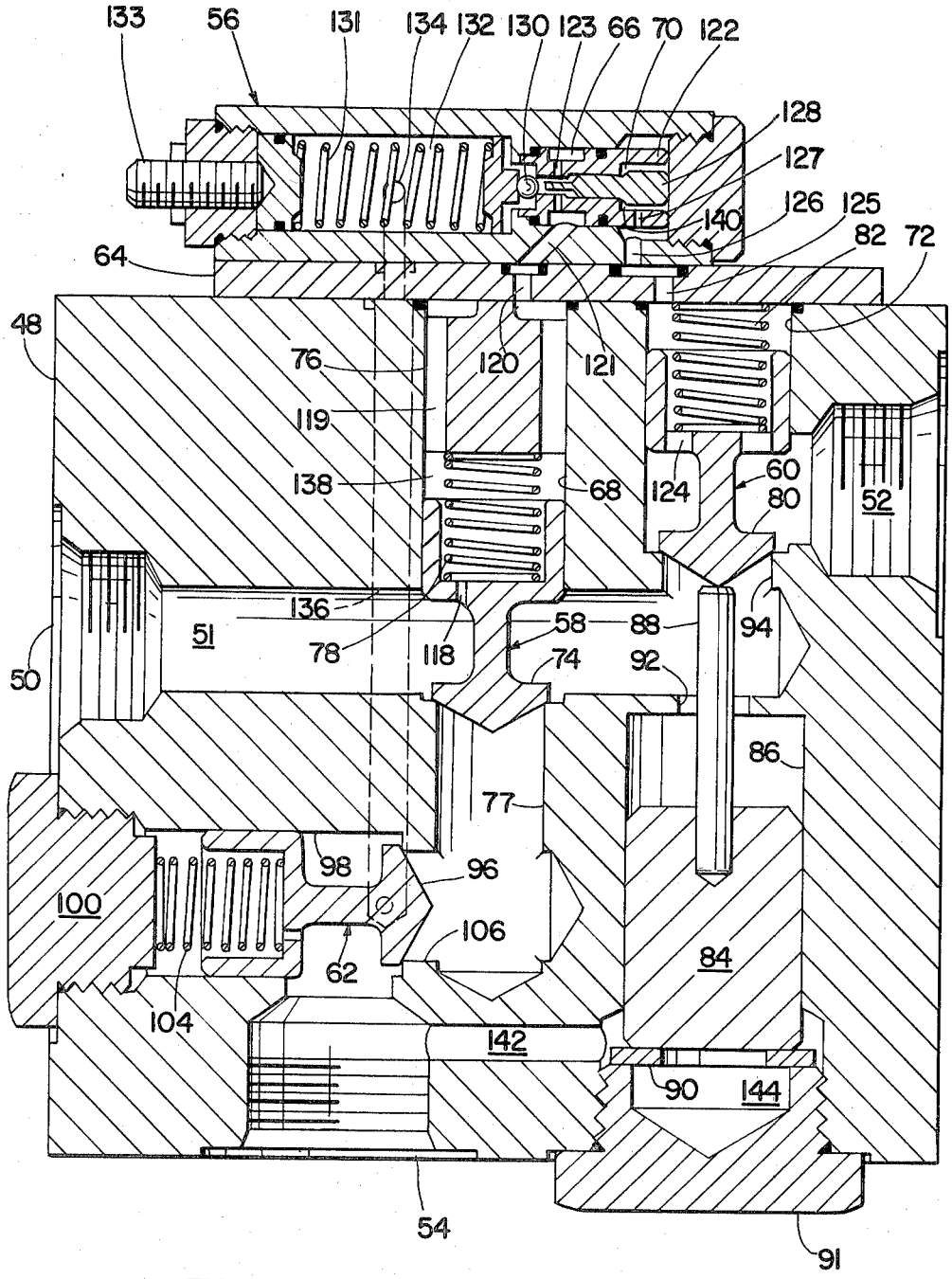

Other features and advantages of the invention will be apparent from the following description when taken in connection with the accompanying drawings, wherein:

FIG. 1 is a schematic diagram of the hydraulic system of the present invention; and FIG. 2 is a cross-sectional view of the valve assembly of the present invention.

Referring to FIG. 1, there is illustrated a hydraulic system 10 for operating a log grapple device 12, comprising a reservoir 14, a pump 16, a control valve assembly 18, an unloader valve assembly 20, and an accumulator 22.

In the illustrative embodiment, the control valve assembly 18 comprises a conventional, manually-actuated, open center spool valve 24, and a relief valve 26. As shown in FIG. 1, in the neutral position of the valve 24, flow from the outlet of the pump 16 is through a line 28 to an inlet port 30 in valve assembly 18, through an internal passage 32 through the open center of the valve and back to reservoir 14 via an internal passage 34 to drain port 36 and drain line 38. Relief valve 26 is connected between internal passages 32 and 34. When the spool valve 24 is moved to the left, flow from inlet passage 32 is through an internal passage 40 to a first outlet port 42. When the valve 24 is moved to the right, flow is through an internal pasage 44 to a second outlet port 46. Pump outlet flow from port 42 goes to the unloader valve assembly via line 47, and output flow from port 46 goes directly to the grapple device via line 49.

Referring particularly to FIG. 2, the unloader valve assembly comprises a valve body 48, an inlet port 50, an outlet port 52, a drain port 54, a pilot valve unit 56 mounted on the body 48, a main poppet valve 58 within the body 48, a pilot check valve 60 within the body 48, and a drain check valve 62 within the body 48.

The pilot valve unit 56 illustrated herein is a portion of a Model 17-1-6 unloading valve manufactured by the Fluid Power Systems Division of AMBAC Industries and will not be described herein in detail. As shown herein, the pilot valve unit 56 is mounted on the body 48 through an adapter plate 64 and includes a first chamber 66 which communicates with a bore 68 which intersects inlet passage 51 extending inward from the inlet port 50 and in which the main poppet 58 is located, a second chamber 70 which communicates with a bore 72 which intersects the outlet port 52 and in which the pilot check valve 60 is located.

The main poppet valve 58 comprises a poppet element 74 received in bore 68, a spacer 76 also received in bore 68, and a spring 78 acting between the poppet and the spacer to bias the poppet into the position shown, and the spacer into engagement with the adapter plate 64 which closes the open end of bore 68. A bore 77 coaxial with bore 68 also intersects inlet passage 51, its intersection with passage 51 defining a valve seat for poppet element 74. The pilot check valve 60 comprises a poppet element 80 received in the bore 72, a spring 82 acting between the poppet element and the adapter plate 64 which closes bore 72, pilot piston element 84 received in a bore 86 coaxial with the bore 72, and a pin 88 received in a hole formed in the end of piston 84 and in engagement with the poppet element 80. A washer 90 is received beneath piston 84, and a plug 91 screwed into a hole formed in the body 48 closes the bore 86. Bore 86 communicates with the inlet passage 51 by means of a short, small-diameter bore 92 through which pin 88 extends. A bore 94 smaller in diameter than bore 72 connects bore 72 and the inlet passage 51, the intersection of bore 72 and bore 94 defining a valve seat for the poppet element 80. The drain check valve 62 comprises a poppet element 96 received in a bore 98 which intersects the drain port 54, a plug 100 which is screwed into a hole formed in the body 48 and which closes the bore 98, and a spring 104 received between the plug 100 and the poppet element 96. A bore 106 connects bore 98 and bore 77, and its intersection with bore 98 defines a valve seat for poppet element 96.

In normal operation of the grapple device 12, oil under pressure flows from the inlet port 50 and inlet passage 51 of unloader valve assembly 20, past the closed main poppet element 74, lifts the poppet element 80 of the pilot check valve 60 off its seat and flows out the outlet port 52 to the head end of a grapple actuating cylinder 108 via line 109, thereby extending a piston rod 110 to close grapple tongs 112 and 114 against a load of logs. When a predetermined pressure is reached, the main poppet element 74 lifts off its seat, along with the check valve poppet element 96 diverting the pump flow to the drain port 54, and back to the reservior 14 via line 49 and control valve 18.

The unloading pressure is controlled by the pilot valve unit 56, which as noted above is a well-known commercially available unit. Inlet pressure is transmitted to the first chamber 66 via a bleed port 118 in poppet element 74, a passage 119 through the spacer 76, a passage 120 through adapter 64, a port 121 in the body of pilot unit 56, and internal ports 123 formed in piston element 122 of the pilot unit. This pressure is also transmitted to chamber 70 via bleed ports 124 formed in poppet element 80, a passage 125 through the adapter 64, a port 126 in the body of pilot valve unit 56, and an internal port 127 in piston element 122. Thus, the forces acting on spool element 128 of the pilot valve unit are balanced, while the pressure in chamber 66 tends to lift ball valve element 130 off its seat. As the predetermined unloading pressure is reached, the ball valve 130 opens allowing the oil in chamber 66 to flow to a chamber 132, through a vent port 134 in the body of the pilot valve unit 56 to the drain port 54 via a passage 136 formed in the valve body 48. When the ball moves off its seat, the pressure in chamber 66 and in chamber 138 above poppet 74 falls below inlet pressure. This unbalances the poppet 74 causing it to lift off its seat and divert the pump output flow to the drain port 54 via bore 77 and drain check valve 62. At this point the pilot check poppet 80 closes to isolate the system downstream of the unloader valve assembly. With the grapple actuating cylinder 108 isolated, the accumulator 22 in line 109 will maintain pressure on the grapple tongs in the event of a shift in the load which would require that the tongs be further closed.

Since chamber 66 is now at low pressure and chamber 70 is still at system pressure, the spool element 128 is now unbalanced and the spool moves to the left to hold ball valve element 130 off its seat, while at the same time sealing against an edge 140 on piston element 122. Since the valve area at edge 140 is greater than the area at the ball valve 130, the valve will not reload unless there is a reduction in system pressure. Accordingly, if during shifting of the load in the grapple the accumulator pressure drops below the reload pressure, the ball valve 130 will again close, thus rebalancing the pressure forces on main poppet element 74 and allowing it to be closed by the force of spring 78 to restore normal flow through the unloader valve element. The unloading pressure is determined by the preload on spring 131 which biases the ball valve 130 in a closed position, and can be adjusted by means of a set screw 133.

When the grapple is to be opened, pump outlet pressure is directed through line 49 to the rod end of cylinder 108, while at the same time oil must flow from the head end of cylinder 108 through the unloader valve assembly 20 to drain via the control valve 18. When drain port 54 is pressurized drain poppet 96 remains closed and system pressure is transmitted via an internal passage 142 to a chamber 144 beneath piston element 84, forcing the piston element upward and causing pin 88 to move poppet element 60 off its seat to permit oil to flow from the outlet port 52, past the closed main poppet 74 and to the inlet port 50.

OPERATION

When the grapple device 12 is to be closed upon a load of logs, the spool valve 24 is moved to the left as viewed in FIG. 1, allowing oil to flow from the reservoir 14 to inlet port 30 via pump 16 and line 28, through passage 32 and 40 to outlet port 42, through line 47 to the inlet port 50 of the unloader valve assembly, through the unloader valve as described above to the outlet port 52, and then via line 109 to the head end of cylinder 108 and to the accumulator 22. Oil from the rod end of cylinder 108 drains back to the reservoir via line 49 to port 46 of control valve 18, and via internal passages 44 and 34 to drain port 36 and to the reservoir via drain line 38. When the predetermined unloading pressure is reached, pump flow is diverted, as described above, through check valve 62 and drain port 54 to the reservoir via line 49 to the control valve 18, and system pressure is maintained on the grapple cylinder 108 by the accumulator.

When the grapple device 12 is to be opened, the spool valve 24 is moved to the right, allowing pressurized oil to flow to the rod end of cylinder 108 via line 28 and passages 32 and 44, outlet port 46, and line 49, while oil from the head end of cylinder 108 and from accumulator 22 drains through line 109 to port 52, through the unloader valve assembly 20 by means of the opening of check valve poppet 80 by the pilot piston 84 as described above, and to the reservoir via line 47, port 42, internal passages 40 and 34, drain port 36, and drain line 38.

I claim:

1. In a log grapple device comprising a pair of tongs mounted for movement toward and away from one another, and at least one hydraulic cylinder connected to said tongs and operable to move said tongs toward and away from one another; a hydraulic circuit for supplying pressurized hydraulic fluid to said cylinder; said hydraulic circuit comprising a reservoir; a pump; a control valve connected between said pump and said cylinder and operable to selectively apply hydraulic fluid to a first side of said cylinder for moving said tongs toward one another and to a second side of said cylinder for moving said tongs away from one another; an unloader valve assembly connected between said control valve and said first side of said cylinder, said unloader valve assembly being operable to direct flow from said pump to said reservoir and prevent flow from said first side through said unloader valve when a predetermined pressure is applied to said first side upon closing of said tongs upon a load grasped therein; and an accumulator connected between said unloader valve assembly and said first side and operable to maintain hydraulic pressure on said first side if said tongs close further upon shifting of the load grasped therein.

2. Apparatus as claimed in claim 1, in which said control valve is an open center valve.

3. Apparatus as claimed in claim 1, in which said unloader valve assembly comprises a body, an inlet passage formed in said body, a drain passage formed in said body intersecting said inlet passage, a first poppet valve between said inlet and drain passage and movable between a first position closing communication between said inlet passage and said drain passage and a second position opening communication between said inlet passage and said drain passage, an outlet passage intersecting said inlet passage downstream of said drain passage, first check valve means between said inlet and outlet passages and normally permitting flow only from said inlet passage to said outlet passage, second check valve means in said drain passage and operable to permit flow only from said inlet passage to said drain passage, and first pilot means communicating with said inlet and outlet passages and operable to cause said first poppet element to move to its second position when said predetermined pressure is reached.

4. Apparatus as claimed in claim 1, in which said hydraulic circuit comprises a first conduit connecting the outlet of said pump to said control valve, a second conduit connecting said control valve to said unloader valve assembly, a third conduit connecting said unloader valve assembly to said first side of said cylinder, a fourth conduit connecting said second side of said cylinder to said control valve, and said unloader valve assembly includes second pilot means operable to open said first check valve means to flow from said outlet passage to said inlet passage when said fourth conduit is pressurized to a predetermined value.

5. Apparatus as claimed in claim 4, in which said second pilot means comprises a piston received within said body, a chamber defined within said body at one end of said piston, pilot conduit means connecting said fourth conduit with said chamber, and means acting between said piston and said second check valve means to move said second check valve to a position permitting flow from said outlet passage to said inlet passage when said chamber is pressurized.

6. Apparatus as claimed in claim 5, in which said second check valve means comprises a poppet element received in a first bore formed in said body and a spring biasing said poppet element to a closed position, said piston is received in a second bore coaxial with the first bore, and said means acting between said poppet element and said piston comprises a pin partially received within an end of said piston and engageable with said poppet element.

* * * * *